US008186170B2

(12) United States Patent
Boatman et al.

(10) Patent No.: US 8,186,170 B2
(45) Date of Patent: May 29, 2012

(54) FLOATING LNG REGASIFICATION FACILITY WITH LNG STORAGE VESSEL

(75) Inventors: L. Terry Boatman, Houston, TX (US); Yonghui Liu, Houston, TX (US)

(73) Assignee: Sofec, Inc., Houston, TX (US)

( * ) Notice: Subject to any disclaimer, the term of this patent is extended or adjusted under 35 U.S.C. 154(b) by 1206 days.

(21) Appl. No.: 11/754,712

(22) Filed: May 29, 2007

(65) Prior Publication Data

US 2008/0295526 A1 Dec. 4, 2008

(51) Int. Cl.

| | |
|---|---|
| ***F17C 9/02*** | (2006.01) |
| ***F17C 13/08*** | (2006.01) |
| ***B63B 21/00*** | (2006.01) |
| ***B63B 35/44*** | (2006.01) |

(52) U.S. Cl. ..... 62/50.2; 62/53.2; 144/230.12; 144/230.15; 144/265

(58) Field of Classification Search ..... None
See application file for complete search history.

(56) References Cited

U.S. PATENT DOCUMENTS

| | | | | |
|---|---|---|---|---|
| 4,826,354 | A | 5/1989 | Adorjan | |
| 5,678,503 | A | 10/1997 | Poranski, Sr. | 114/230 |
| 5,755,607 | A | 5/1998 | Boatman et al. | 441/5 |
| 5,893,334 | A | 4/1999 | Poranski, Sr. | 114/230 |
| 5,983,931 | A | 11/1999 | Ingebrigtsen et al. | |
| 6,257,801 | B1 | 7/2001 | Kelm et al. | 405/224.2 |
| 6,434,948 | B1 * | 8/2002 | Eide et al. | 62/50.1 |
| 6,517,290 | B1 | 2/2003 | Poldervaart | |
| 6,712,560 | B1 | 3/2004 | Cottrell | 405/224.4 |
| 6,829,901 | B2 | 12/2004 | Harley et al. | |
| 6,851,994 | B2 | 2/2005 | Boatman et al. | 441/4 |
| 6,979,147 | B1 * | 12/2005 | Wille et al. | 405/8 |
| 6,990,917 | B2 | 1/2006 | Boatman et al. | |
| 7,007,623 | B2 | 3/2006 | Boatman et al. | |
| 7,063,032 | B2 | 6/2006 | Lindblade et al. | |
| 7,073,457 | B2 | 7/2006 | Boatman | |
| 7,179,144 | B2 | 2/2007 | De Baan | 441/5 |
| 7,182,660 | B2 | 2/2007 | De Baan | 441/5 |
| 2002/0174662 | A1 * | 11/2002 | Frimm et al. | 62/50.2 |
| 2004/0025772 | A1 | 2/2004 | Boatman | 114/230.15 |
| 2004/0094082 | A1 * | 5/2004 | Boatman et al. | 114/249 |
| 2005/0039665 | A1 * | 2/2005 | Wille et al. | 114/230.14 |
| 2005/0042035 | A1 * | 2/2005 | de Baan | 405/169 |
| 2005/0047873 | A1 * | 3/2005 | De Baan | 405/169 |
| 2005/0193938 | A1 * | 9/2005 | Boatman et al. | 114/230.1 |
| 2006/0080973 | A1 * | 4/2006 | Pollack et al. | 62/50.2 |
| 2006/0156744 | A1 * | 7/2006 | Cusiter et al. | 62/50.2 |
| 2007/0074786 | A1 | 4/2007 | Adkins et al. | |

* cited by examiner

*Primary Examiner* — Frantz Jules
*Assistant Examiner* — Lukas Baldridge
(74) *Attorney, Agent, or Firm* — Gary L. Bush; Andrews Kurth LLP

(57) ABSTRACT

An LNG terminal is disclosed which includes an offshore mooring turret, an LNG storage vessel operatively coupled to the mooring turret, the LNG storage vessel including at least one LNG storage tank for the storage of liquid natural gas and a regasification vessel operatively coupled to the LNG storage vessel. A method of operating an offshore LNG terminal is also disclosed which includes obtaining liquefied natural gas from at least one LNG storage tank on an LNG storage vessel that is operatively coupled to a mooring turret, regasifying the liquefied natural gas from the LNG storage vessel using a regasification vessel operatively coupled to the LNG storage vessel, and supplying the regasified gas to at least one subsea pipeline via the mooring turret.

19 Claims, 12 Drawing Sheets

FLOATING LNG REGASIFICATION FACILITY WITH LNG STORAGE VESSEL

BACKGROUND OF THE INVENTION

1. Field of the Invention

The present invention is generally related to liquid natural gas (LNG) processing systems, and, more particularly, to a floating LNG regasification facility with an LNG storage vessel.

2. Description of the Related Art

Natural gas is captured from subterranean structures via natural gas wells. The natural gas is then processed to convert it from a gaseous state to a liquid state—liquefied natural gas (LNG). LNG is typically transported as a liquid via specialized LNG carrier vessels. A floating LNG terminal is provided for offloading the LNG carrier vessel in the sea. The floating LNG terminal typically comprises a regasification vessel that is used to regasify the LNG, i.e., to convert the liquid gas to its gaseous form. The gas is then transported to various onshore facilities via undersea gas pipelines.

The marine operations involved in safely berthing an LNG carrier to another floating vessel in the open sea are known by the offshore industry to be a dangerous, high risk endeavor. It is generally understood that sea-going tug boats cannot safely operate to push against the side of an LNG carrier under high sea conditions, e.g., seas having a significant wave height (Hs) greater than about 1-1.5 meters. Generally during berthing operations, the LNG carrier is positioned such that the longitudinal axis of the LNG carrier lies approximately parallel, more or less, to the direction of the wind and waves. Accordingly, in operation, the sea-going tug boats that push on the sides of the LNG vessel are positioned more broadside to the wind and waves and therefore suffer severe rolling motion while they attempt to push an LNG carrier toward its berth adjacent another floating vessel. To the extent that the LNG carrier and the other floating vessel to which it will be berthed have traditional hull configurations, the problems associated with berthing may be more difficult as both vessels may tend to roll with an increasing relative magnitude as they approach one another.

In many situations, the regasification process is a limiting factor as it relates to how fast the LNG can be offloaded from an LNG carrier vessel. For example, an LNG carrier vessel may be temporarily moored to the regasification vessel for three days to fully offload and regasify the LNG on the LNG carrier vessel. The specialized LNG carrier vessels are very expensive to operate. The time spent in completely offloading a loaded LNG carrier vessel is very expensive. Moreover, the longer the loaded LNG carrier vessel remains positioned beside the regasification vessel and connected for offloading LNG, the greater the possibility of mishaps or accidents occurring. Additionally, consumers that purchase the gasified LNG typically like to have the purchased volume supplied to them in a continuous fashion. For example, some customers do not like to receive one-half of the purchased quantity on day 1 and have to wait until, for example, day 5 to receive the remainder of the purchased product. With existing offshore LNG terminals, depending upon the timing of the customer's overall product demand and the arrival of the seagoing LNG carrier vessels, it may not be possible to supply the purchased product in a continuous fashion.

The present invention is directed to various devices and methods for solving, or at least reducing the effects of, some or all of the aforementioned problems.

SUMMARY OF THE INVENTION

The following presents a simplified summary of the invention in order to provide a basic understanding of some aspects of the invention. This summary is not an exhaustive overview of the invention. It is not intended to identify key or critical elements of the invention or to delineate the scope of the invention. Its sole purpose is to present some concepts in a simplified form as a prelude to the more detailed description that is discussed later.

In one illustrative embodiment, an LNG terminal is disclosed which comprises an offshore mooring turret, an LNG storage vessel operatively coupled to the mooring turret, the LNG storage vessel including at least one LNG storage tank for the storage of liquid natural gas and a regasification vessel operatively coupled to the LNG storage vessel.

In one illustrative embodiment, a method of operating an offshore LNG terminal is disclosed which comprises obtaining liquefied natural gas from at least one LNG storage tank on an LNG storage vessel that is operatively coupled to a mooring turret, regasifying the liquefied natural gas from the LNG storage vessel using a regasification vessel operatively coupled to the LNG storage vessel, and supplying the regasified gas to at least one subsea pipeline via the mooring turret.

BRIEF DESCRIPTION OF THE DRAWINGS

The invention may be understood by reference to the following description taken in conjunction with the accompanying drawings, in which like reference numerals identify like elements, and in which:

FIG. 3 is an end view of the LNG regasification vessel and the LNG carrier;

Figure 1:
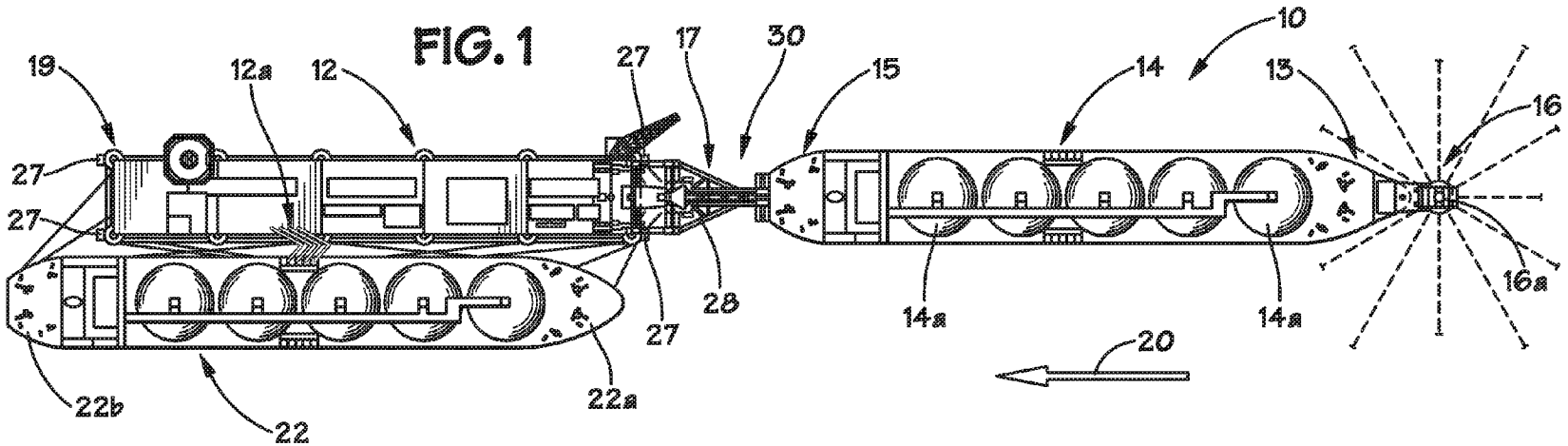
FIG. 1 is a plan view depicting one illustrative embodiment of the present invention.
Figure 2:
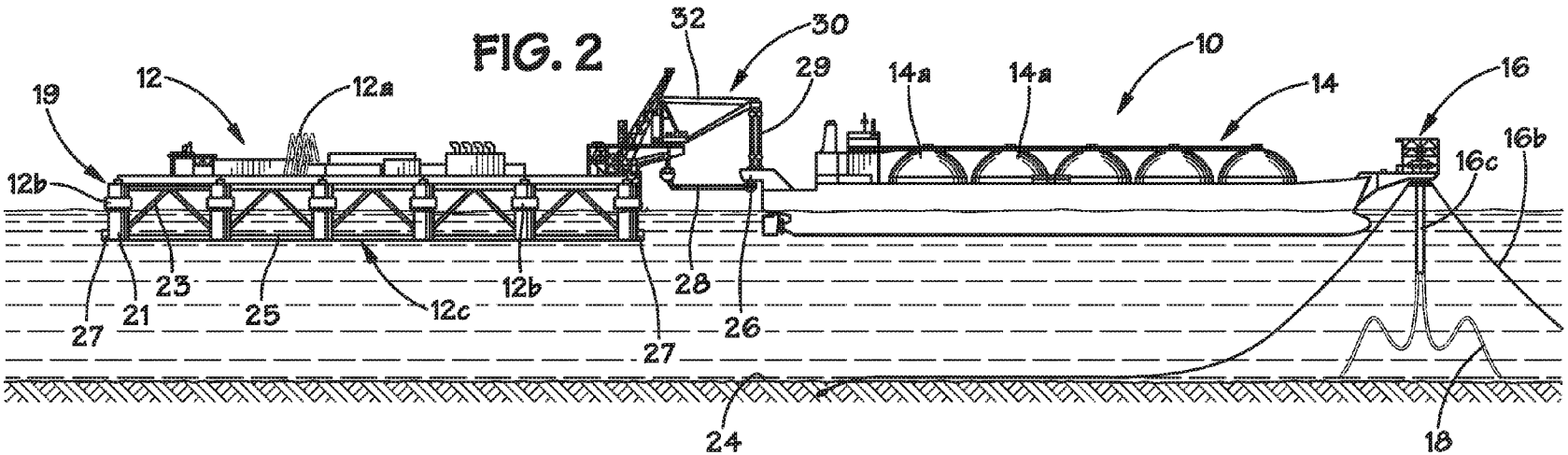
FIG. 2 is a side view of the structure depicted in FIG. 1 without the LNG carrier.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The present invention will now be described with reference to the attached figures. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

FIGS. 1-5 are various views that depict one illustrative embodiment of a floating LNG import and regasification terminal 10 in accordance with the present invention. In the depicted embodiment, the terminal 10 comprises a floating regasification vessel 12 and a floating LNG storage vessel 14. The LNG storage vessel 14 is rotatably moored to a mooring turret 16 that is anchored to the sea floor 24 and operatively coupled to a plurality of subsea pipelines 18. The floating terminal 10 is free to rotate or "weathervane" around the mooring turret 16. Typically, the terminal 10 will align with the wind direction, as indicated by the arrow 20. In the depicted embodiment, the mooring turret 16 is an external-type mooring turret that is externally mounted off of the forward end 13 of the LNG storage vessel 12. Of course, if desired, the LNG storage vessel 16 could be configured such that the mooring turret is mounted internally to the forward end of the LNG storage vessel 14. The decision on whether to employ an internal or external mooring arrangement may vary depending upon the particular application.

Also depicted is an illustrative LNG carrier vessel 22 docked to the regasification vessel 12. The LNG carrier vessel 22 may be docked adjacent the regasification vessel 12 using a variety of known techniques. One illustrative technique for docking the LNG carrier vessel 22 is described in published U.S. patent application 2005/0193938, which is hereby incorporated by reference in its entirety. Other illustrative techniques will be described more fully below. The LNG carrier vessel 22 may be of any desired shape or configuration.

The regasification vessel 12 comprises various process units and equipment for regasifying liquid natural gas. The various process units and associated equipment that will typically be present on the regasification vessel 12 are well known to those skilled in the art and will not be further described herein so as not to obscure the present invention. For example, the regasification vessel 12 may comprise a plurality of LNG loading arms 12*a*, a plurality of marine fenders 12*b*, a floating column stabilized platform 12*c*, and various items of vaporization process equipment, such as LNG pumps, vaporizers (alternatively named heat exchangers or warmers), LNG storage for operation of the LNG pumps and for fuel supply, generators, water pumps, gas metering, and the like. Flexible cryogenic hoses may also be employed in addition to or as an alternative to the illustrative LNG loading arms.

The regasification vessel 12 may be of any desired shape or configuration. In one particular example, the regasification vessel 12 may have the structure and configuration of the terminal disclosed in U.S. Patent Publication No. 2005/0193938, which is hereby incorporated by reference in its entirety. In one particular example, the open frame, floating, stabilized platform 12C comprises buoyant columns 21, a series of diagonal members 23, buoyant horizontal structural members (pontoons) 25. A deck is mounted on the stabilized floating structure. Members 21, 23, and 25 are sealed from intrusion by the sea, are buoyant and serve to support the regasification vessel 12 while also containing compartments for ballast, pumps and other ancillary equipment. One or more reversible marine thrusters 27 are located on the regasification vessel 12 for the purpose of pivoting the regasification vessel 12 relative to the LNG storage vessel 14 at the pivot connection point 30. Pneumatic fenders 12*b*, or other types of compliant marine docking fenders, are located along the side of regasification vessel 12 and attached by various fender supports.

The LNG storage vessel 14 may also be of any desired shape and configuration. For example, the LNG storage vessel 14 may be an LNG carrier vessel that has been taken out of service as it relates to the ocean transportation of LNG. The LNG storage vessel 14 may also be a barge-like structure of desired shape or configuration. A plurality of illustrative LNG storage tanks 14*a* are positioned on the LNG storage vessel 14. The LNG storage tanks 14*a* may be of conventional construction. In one example, the LNG storage vessel 14 may be provided with enough storage tanks 14*a* to store at least 50,000 cubic meters of LNG. The exact storage capacity of the LNG storage vessel 14 may vary depending upon the particular application.

Figure 5:
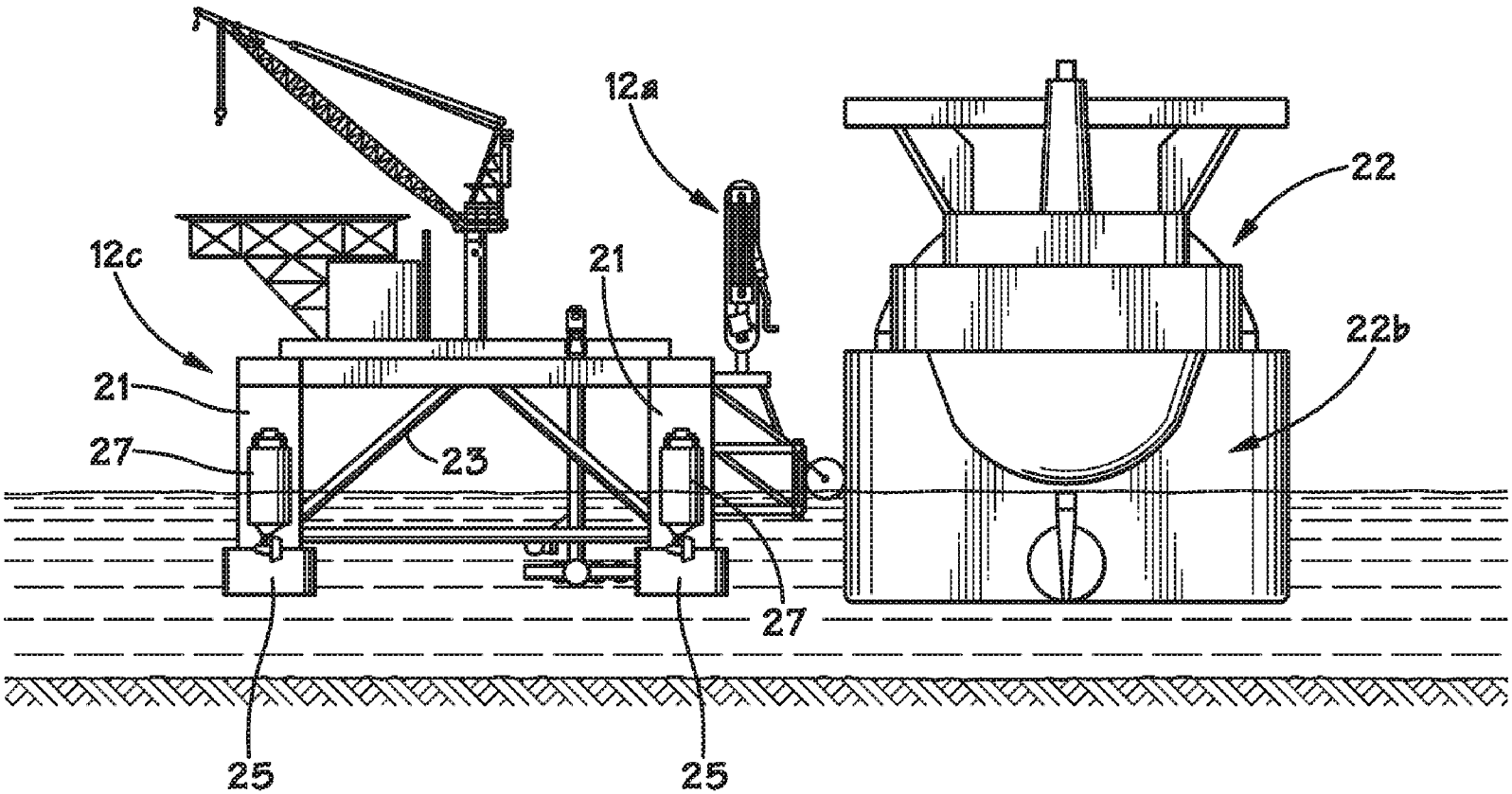
FIG. 5 is a schematic depiction of the piping arrangement between the regasification vessel and the LNG storage vessel.
Figure 4:
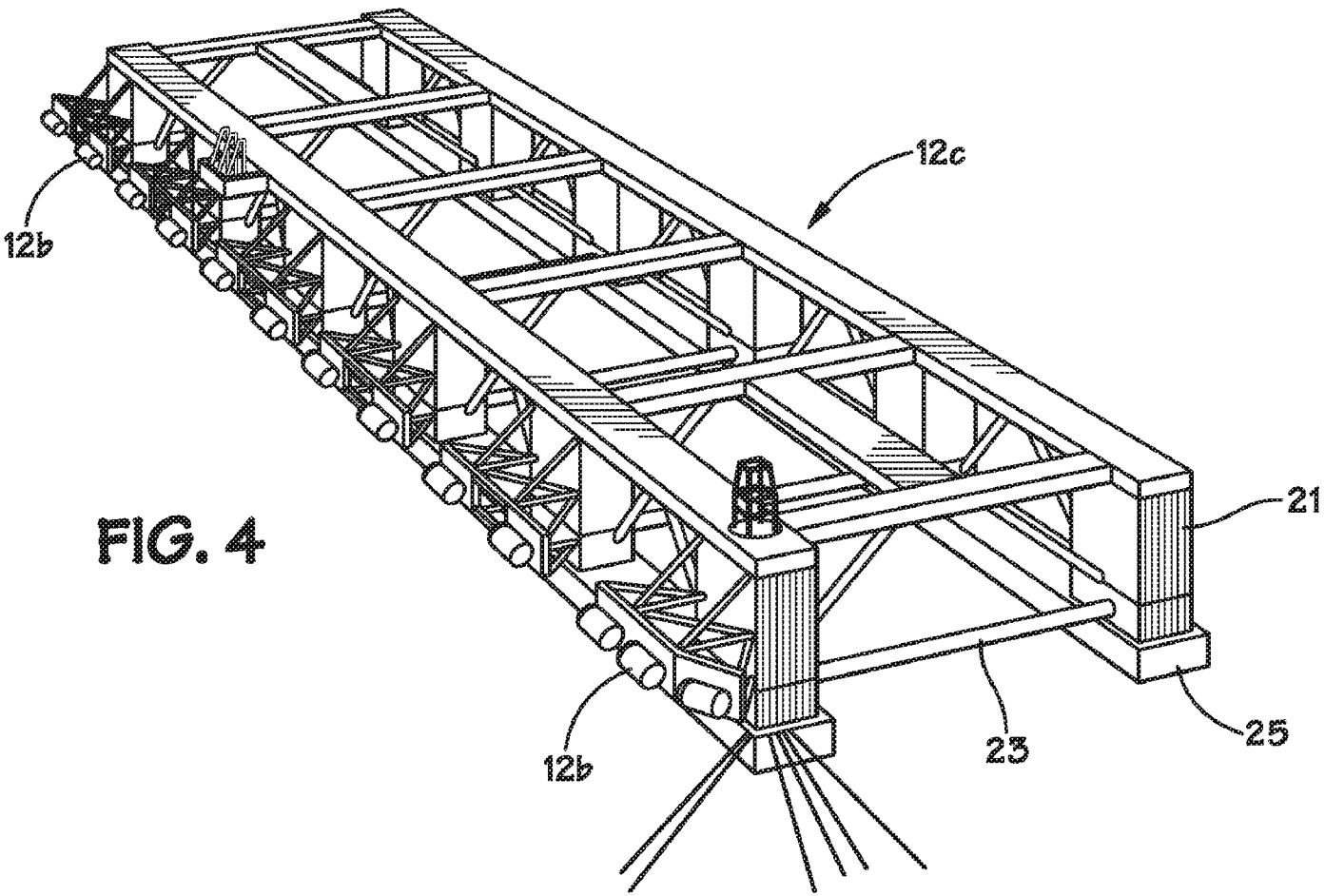
FIG. 4 is a perspective view of an illustrative embodiment of the LNG regasification vessel.
Figure 5:
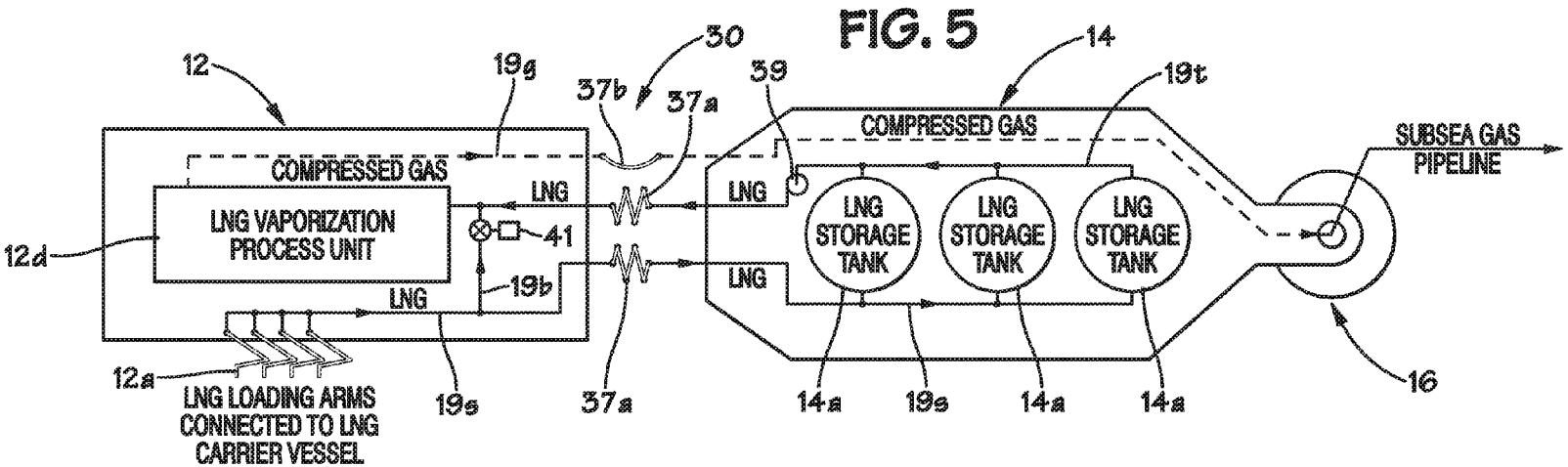

Various piping arrangements may be used to transfer LNG between the LNG storage vessel 14 and the regasification vessel 12. FIG. 5 schematically depicts one illustrative piping arrangement that may be employed with the LNG terminal 10 described herein. As shown therein, the LNG terminal 10 comprises schematically depicted LNG supply lines 19*s*, 19*t*. The supply line 19*s* is operatively coupled to the LNG loading arms 12*a* and LNG from a LNG carrier 22 may be offloaded through the supply line 19*s*. LNG within the supply line 19*s* may be routed to one or more of the storage tanks 14*a* on the LNG storage vessel 14. LNG from the storage tanks 4*a* may be supplied to the regasification vessel 12 via line 19*t*. The illustrative pump 39 schematically depicted in FIG. 5 may be employed during the process of supplying LNG from the storage tank 14*a* to the regasification vessel 12. If desired, LNG from the LNG loading arms 12*a* may be routed directly to the schematically depicted LNG vaporization unit 12*d* on the regasification vessel 12 by opening valve 41. Vaporized LNG is returned to the mooring turret 16 via line 19*g*. A plurality of flexible pipe jumpers 37*a* may be employed to flexibly couple piping on the LNG storage vessel 14 and the regasification vessel 12. A flexible hose 37*b* may be employed to define a flexible connection or portion of the line 19*s* in the space between the regasification vessel 12 and the LNG storage vessel 14.

The mooring turret 16 may also be of any desired or known structure. The mooring turret 16 may comprise a gas swivel 16*a* and a plurality of anchor legs 16*b* that are anchored to the sea floor 24. A plurality of flexible riser conductors 16*c* are operatively coupled to the mooring turret 16. In turn, the flexible riser conductors 16*c* are operatively coupled to a plurality of illustrative subsea gas pipelines 18 positioned on the sea floor 24. The LNG storage vessel 14 may be operatively coupled to the mooring turret 16 using any of a variety of known techniques and devices.

The regasification vessel 12 may be pivotally coupled to the LNG storage vessel 14 by a variety of techniques. For example, the pivotal connection may be made through use of a soft yoke 28. In one illustrative embodiment, the regasification vessel 12 may be coupled to the LNG storage vessel 14 by utilizing a duplex yoke system described in U.S. Pat. No. 7,073,457 B2, which is hereby incorporated by reference in its entirety. The mechanical connection between the regasification vessel 12 and the LNG storage vessel 14 may be provided with a yoke disconnect 26 such that it may be rapidly disconnected in the case of an emergency. For example, the yoke 28 may be like the apparatus described in U.S. Pat. No. 7,007,623, which is hereby incorporated by reference in its entirety.

The terminal 10 also comprises means for transferring LNG between the regasification vessel 12 and the LNG storage vessel 14. In one illustrative embodiment, a plurality of flexible conductors 29 that are supported by a support boom 32 are used for this purpose. A pantograph of cryogenic pipes or flexible cryogenic hose may be employed to accomplish the transfer of LNG between the regasification vessel 12 and the LNG storage vessel 14. One illustrative apparatus for accomplishing this task is described in U.S. Pat. No. 6,851,994, which is hereby incorporated by reference in its entirety.

In the illustrative embody depicted in FIGS. 1-5, the LNG storage vessel 14 is rotatably coupled to the mooring turret 16 and the regasification vessel 12 is pivotally coupled to the aft end 15 of the LNG storage vessel 14 at a connection point generally designated within the reference number 30. In general, this pivotable arrangement may be advantageous since the regasification vessel 12 will typically be positioned downwind of the LNG storage vessel 14. In operation, the regasification vessel 12 may pivot about the pivot connection 30 within a range of approximately ±60 degrees relative to a longitudinal axis of the LNG storage vessel 14. An angle of ±90 degrees is an approximate structural limit above which collision interference could be expected.

FIGS. 6A-6G depict one illustrative example of a technique for berthing an LNG carrier vessel 22 adjacent the regasification vessel 12. The direction of prevailing weather conditions, e.g., wind, seas, etc., is depicted by the arrow 20. A plurality of illustrative sea-going tug boats 40 are depicted in the figures, however, those skilled in the art will understand that the number of tug boats 40 employed may vary depending upon the particular application. For example, in some situations, only a single tug boat 40 may be required.

Initially, the longitudinal axis of the regasification vessel 12 is approximately aligned with the prevailing wind direction 20. The regasification vessel 12 is then pivoted away from the berthing line 50 (in the direction indicated by the arrow 43) by use of one or more of the thrusters 27 on the regasification vessel 12. Thereafter, the LNG carrier vessel 22 is towed to it approximate berthing position 51.

Figure 6F:
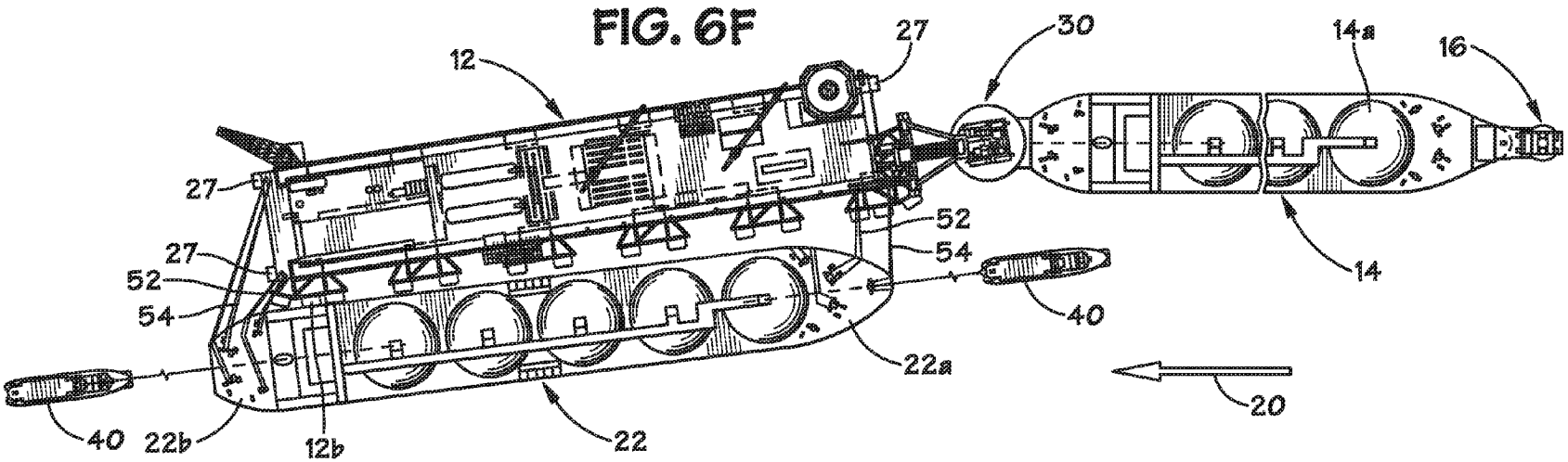
FIGS. 6A-6G depict one illustrative technique for berthing an LNG carrier vessel to the regasification vessel.
Figure 6A:
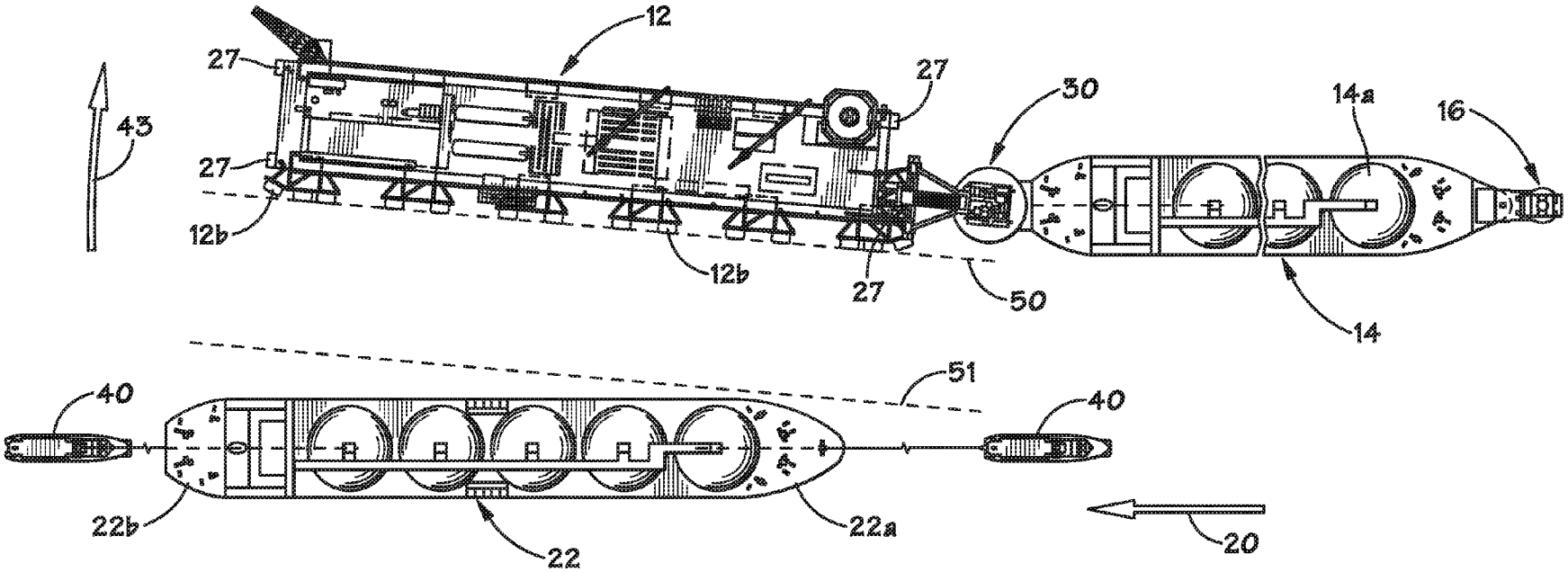
Figure 6B:
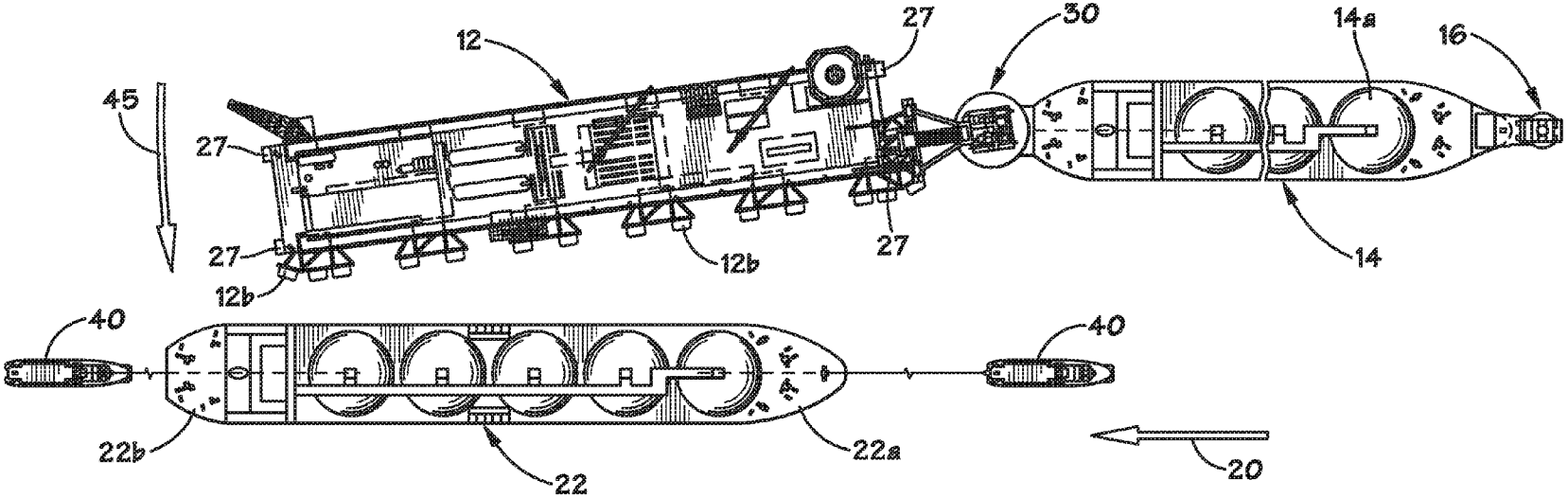
Figure 6C:
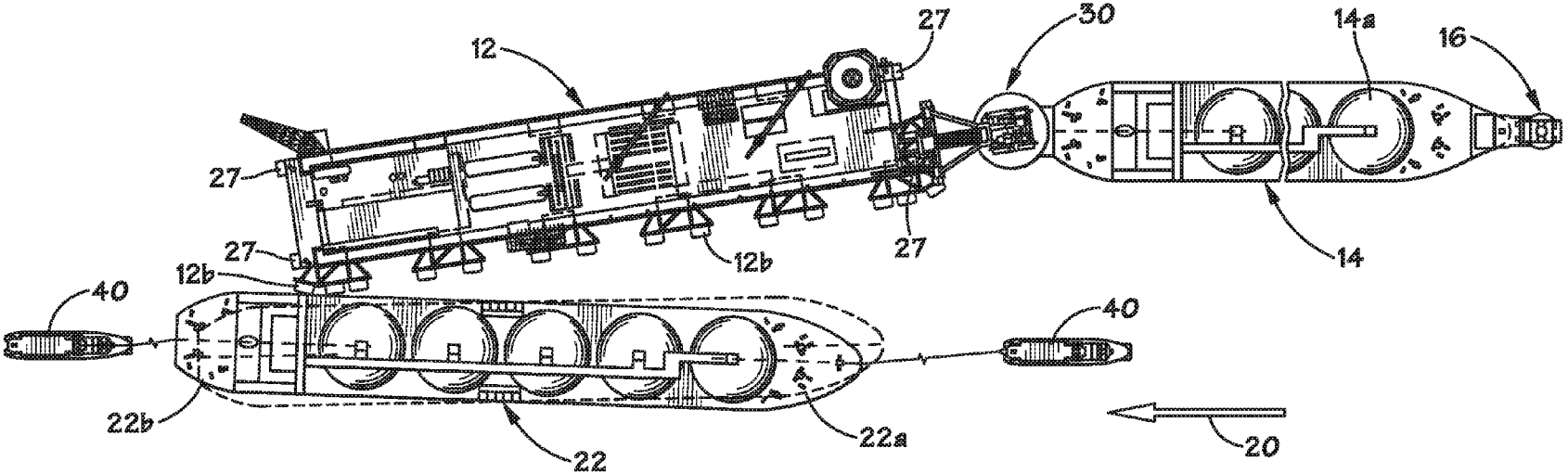
Figure 6D:
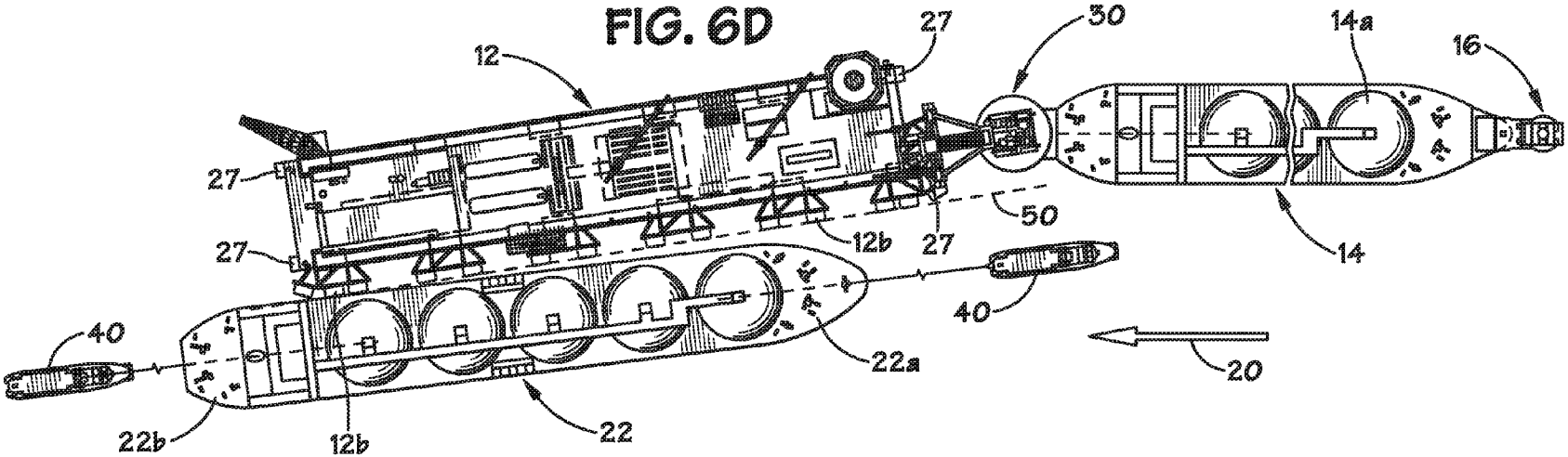
Figure 6E:
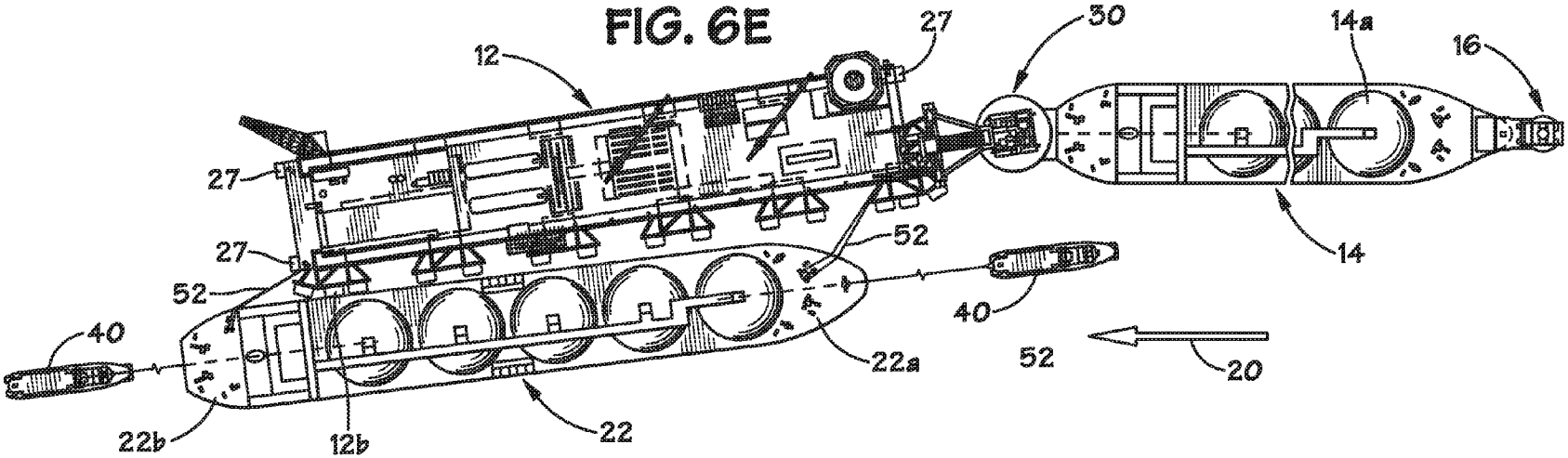

As shown in FIG. 6B, the regasification vessel 12 is then moved (in the direction indicated by the arrow 45) toward the LNG carrier vessel 22 using the thrusters 27. The tug boats 40 are used to maintain the LNG carrier vessel 22 near its berthing position. As shown in FIG. 6C, the thrusters 27 are employed to move the regasification vessel 12 such that the fenders 12*b* engage the LNG carrier vessel 22. The movement of the regasification vessel 12 will be coordinated with the yaw motion of the LNG carrier vessel 22 (as reflected by the dashed lines) during this process. In FIG. 6D, the thrusters 27 are employed to continue urging the regasification vessel 12 against the LNG carrier vessel 22 to thereby bring the LNG carrier 22 heading around toward the berthing line 50 of the regasification vessel 12. The tug boats 40 are used to hold the LNG carrier vessel 22 fore and aft as is practical. Next, as shown in FIG. 6E, one or more mooring lines 52 are coupled to the regasification vessel 12. The LNG carrier vessel 22 is maintained in position against the fenders 12*b* of the regasification vessel 12 using the fore and aft tug boats 40. During this process, the regasification vessel 12 is being pushed against the LNG carrier vessel 22 such that the LNG carrier vessel 22 is partially beam-on to the wind 20, a position that tends to urge the LNG carrier vessel 22 toward the regasification vessel 12. As shown in FIG. 6F, additional mooring lines 54 are attached and the tug boats 40 are employed to move the LNG carrier vessel 22 forward and approximately align the midship of the LNG carrier vessel 22 with the loading arms 12*a* on the regasification vessel 12. Thereafter, the loading arms 12*a* are operatively coupled to the LNG carrier vessel 22.

Figure 6G:
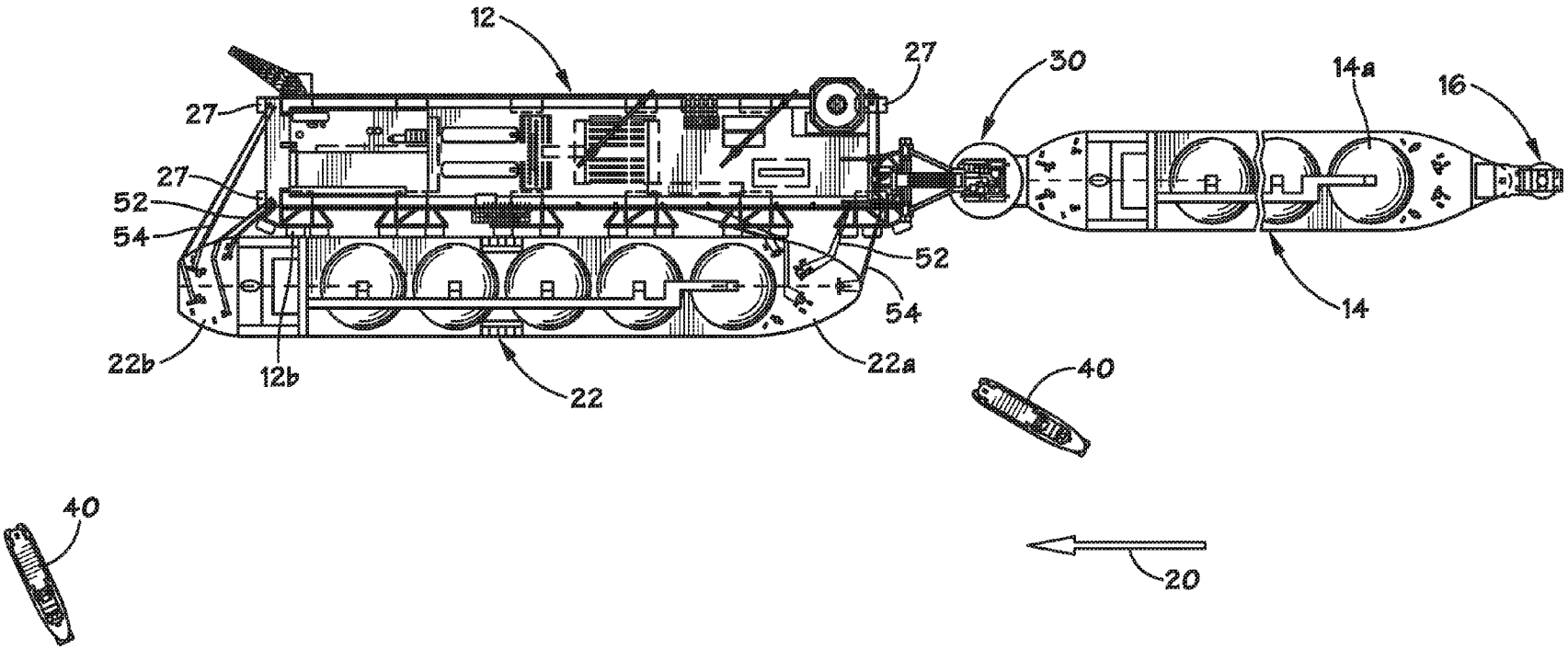

As shown in FIG. 6G, with the mooring lines 54 secured, the tug boats 40 can move to a standby location. LNG loading and regasification processes can now be performed. In the position depicted in FIG. 6G, the regasification vessel 12 and LNG carrier vessel 22 are free to rotate or weathervane around the mooring turret 16. Additionally, the combination of the regasification vessel 12/LNG carrier vessel 22 is free to pivot relative to the LNG storage vessel 10 via the pivot connection 30. If needed, the thrusters 27 on the regasification vessel 12 may be employed to adjust the heading of the regasification vessel 12 and the LNG carrier vessel 22 to the most favorable direction (in terms of weather or conditions) to minimize roll or movement of the LNG carrier vessel 22 during LNG offloading operations. During such activities, various sensors may be employed to monitor the loading applied to the mooring lines 52, 54, and the pretension of the lines 52, 54 may be adjusted as deemed necessary.

Figure 7A:
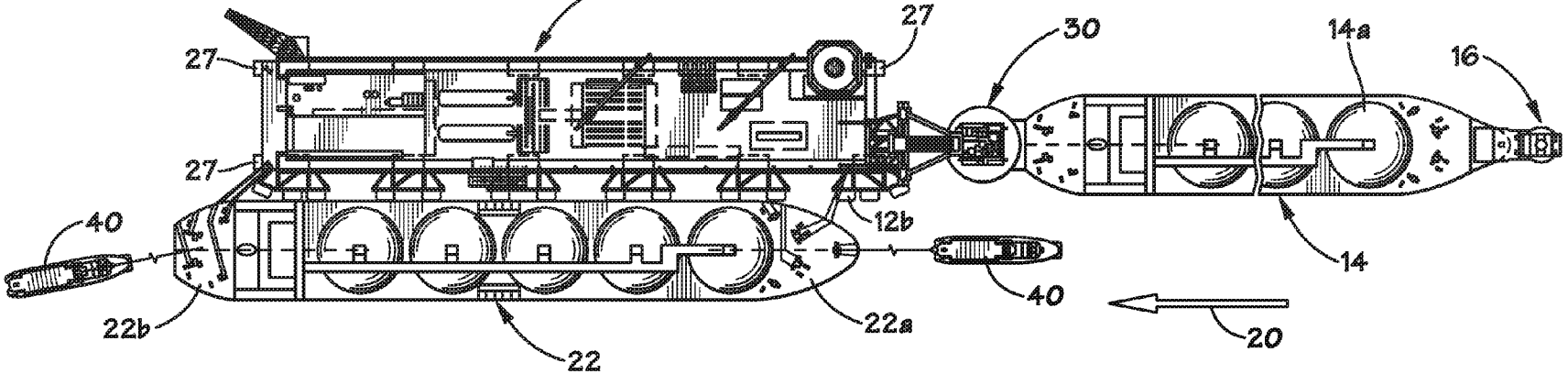
FIGS. 7A-7D depict one illustrative technique for deberthing the LNG carrier vessel from the regasification.
Figure 7B:
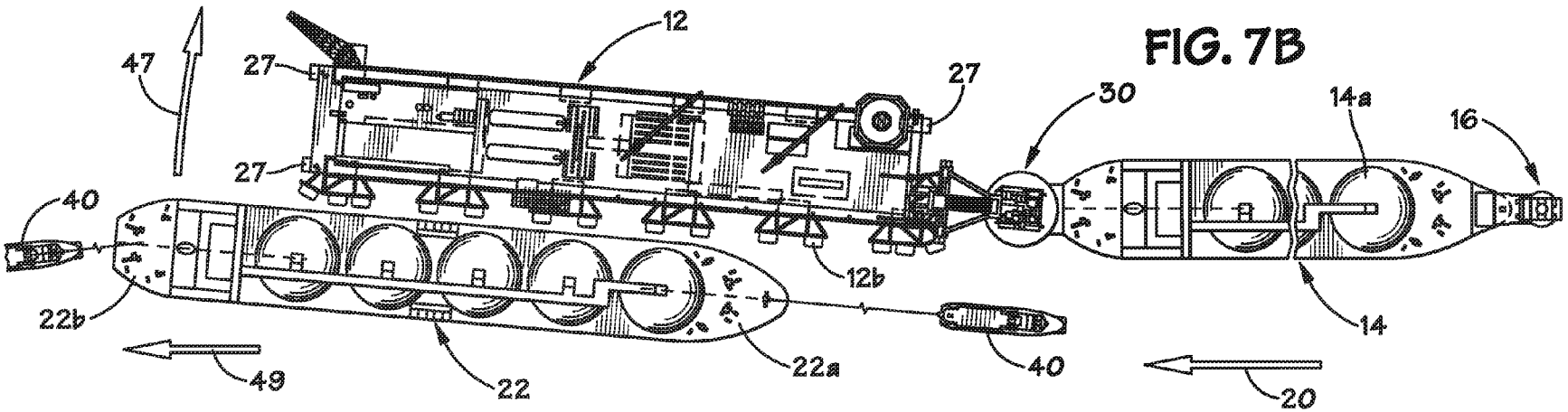
Figure 7C:
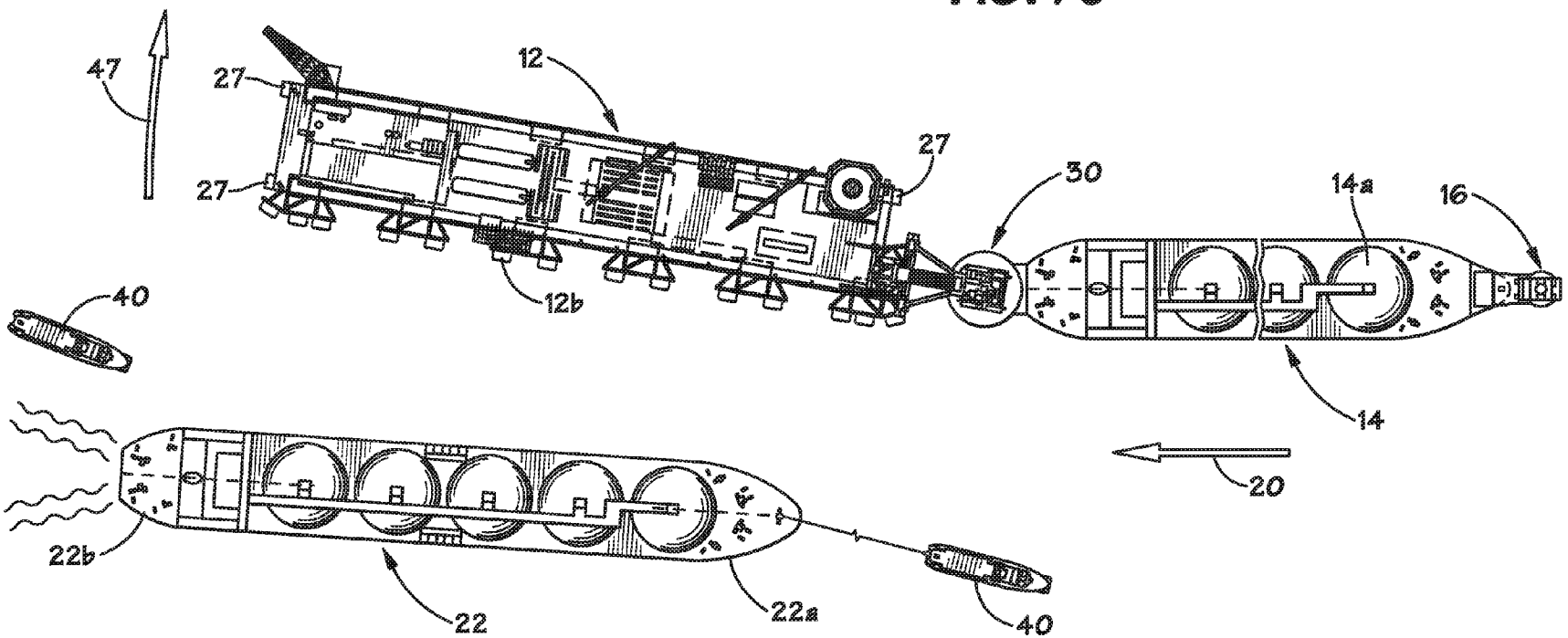
Figure 7D:
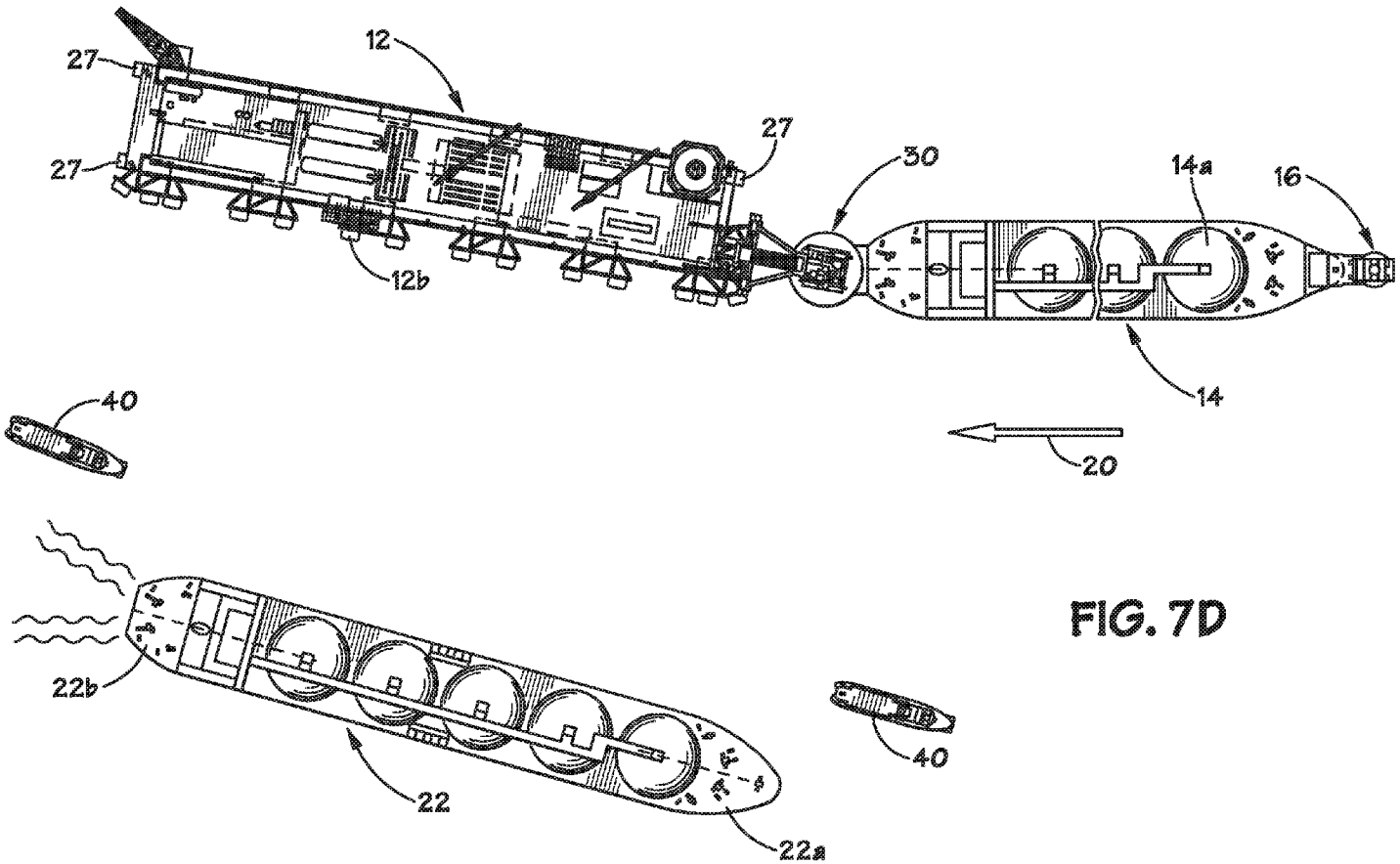

FIGS. 7A-7D depict the deberthing of the LNG carrier vessel 22 after LNG offloading operations are complete. Initially, the LNG loading arms 12*a* are disconnected and the lines from the tug boats 40 are re-attached. The tug boats 40 are positioned fore and aft of the LNG carrier vessel 22 as part of this deberthing operation. As shown in FIG. 7B, using the thrusters 27 on the regasification vessel 12, the regasification vessel 12 is moved or pivoted in the direction indicated by the arrow 47 to create a lee on the fender side of the regasification vessel 12. All mooring lines 52, 54 are released and recovered to the LNG carrier vessel 22. As the mooring lines 52, 54 are released, the regasification vessel 12 is relatively rapidly moved away from the LNG carrier vessel 22 using the thrusters 27 on the regasification vessel 12. As this is occurring, the tug boats 40 begin moving the LNG carrier vessel 22 astern (in the direction indicated by the arrow 49) and swinging the bow of the LNG carrier vessel 22 away from the regasification vessel 12 using the wind direction to assist, if necessary. The tug boats 40 control the heading of the LNG carrier vessel 22 for departure and tow the LNG carrier vessel 22 clear of the regasification vessel 12. In FIG. 7C, the tug boats 40 and the LNG carrier vessel 22 continue to move away from the regasification vessel 12. When the LNG carrier vessel 22 is operating under its own power, the tow lines from the tug boats 40 are released. As shown in FIG. 7D, the tug boats 40 may be used to escort the LNG carrier vessel 22 to a safe distance from the LNG terminal 10.

In one illustrative embodiment, an LNG terminal is disclosed which comprises an offshore mooring turret, an LNG storage vessel operatively coupled to the mooring turret, the LNG storage vessel including at least one LNG storage tank for the storage of liquid natural gas and a regasification vessel operatively coupled to the LNG storage vessel.

In one illustrative embodiment, a method of operating an offshore LNG terminal is disclosed which comprises obtaining liquefied natural gas from at least one LNG storage tank on an LNG storage vessel that is operatively coupled to a mooring turret, regasifying the liquefied natural gas from the LNG storage vessel using a regasification vessel operatively coupled to the LNG storage vessel, and supplying the regasified gas to at least one subsea pipeline via the mooring turret.

The particular embodiments disclosed above are illustrative only, as the invention may be modified and practiced in different but equivalent manners apparent to those skilled in the art having the benefit of the teachings herein. For example, the process steps set forth above may be performed in a different order. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed:

1. An offshore LNG terminal for providing a continuous supply of gas to a subsea gas pipeline (18), comprising:

an offshore mooring turret (16) operatively connected to at least one subsea gas pipeline (18);

an LNG storage vessel (14) coupled to said mooring turret (16) and having at least one LNG storage tank (14*a*);

an LNG regasification vessel (12) which is a separate and distinct vessel from said LNG storage vessel (14), coupled to said LNG storage vessel (14) by a pivot connection coupling (30) whereby said LNG regasification vessel (12) can be pivoted with respect to said LNG storage vessel (14), said LNG regasification vessel (12) having an LNG vaporization unit (12*d*) for converting LNG to compressed gas;

a separate LNG carrier vessel (22) arranged and designed for docking to said LNG regasification vessel (12);

an LNG supply line path (19*s*, 19*b*) arranged and designed to deliver LNG to said LNG vaporization unit (12*d*) from said LNG carrier vessel (22), an LNG supply line path (19*s*) from said LNG carrier vessel (22) to said at least one LNG storage tank (14*a*), and an LNG supply line path (19*t*) from said at least one LNG storage tank (14*a*) to said LNG vaporization unit (12*d*) so that LNG may be supplied to said LNG vaporization unit (12*d*) continuously from either said LNG carrier vessel (22) or said at least one LNG storage tank (14*a*);

a compressed gas supply line (19*g*) arranged and designed to continuously deliver gas from said LNG vaporization unit (12*d*) to said subsea gas pipeline (18); and wherein said LNG storage vessel (14) has a forward end (13) and an aft end (15), said LNG storage vessel (14) rotatably coupled to said mooring turret (16) at said forward end (13) and to said regasification vessel (12) at said aft end (15).

2. The offshore LNG terminal of claim 1, wherein said pivot connection coupling (30) allows said LNG regasification vessel (12) to rotate with respect to said LNG storage vessel (14) during mooring operations of said LNG carrier vessel (22) to said LNG regasification vessel (12).

3. The offshore LNG terminal of claim 1, wherein said regasification vessel (12) is coupled to said LNG storage vessel (14) by a yoke (28).

4. The offshore LNG terminal of claim 1, wherein said regasification vessel (12) includes LNG loading arms (12*a*) that are adapted to transfer LNG from said LNG carrier vessel (22) to said LNG supply line paths (19*s*, 19*b*), 19*s*.

5. The offshore LNG terminal of claim 1, wherein said mooring turret (16) is positioned exteriorly of said LNG storage vessel (14).

6. The offshore LNG terminal of claim 1, wherein said mooring turret (16) is positioned interiorly of said LNG storage vessel (14).

7. The offshore LNG terminal of claim 1, wherein said LNG regasification vessel (12) is an open frame floating structure (12*c*) having first and second ends and a deck mounted on said open frame floating structure (12*c*).

8. The offshore LNG terminal of claim 7, wherein said open frame floating structure (12*c*) includes a plurality of horizontal pontoons (25) and a plurality of buoyant columns (21).

9. The offshore LNG terminal of claim 8, wherein said regasification vessel (12) further comprises a plurality of thrusters (27) mounted to said open frame floating structure (12*c*), said thrusters (27) arranged to provide torque to said open frame floating structure (12*c*) to pivot said regasification vessel (12) relative to said LNG storage vessel (14).

10. An offshore LNG terminal for decreasing the amount of time for transferring LNG from an LNG carrier vessel (22), comprising:

an offshore mooring turret (16);

an LNG storage vessel (14) coupled to said mooring turret (16) and having at least one LNG storage tank (14*a*);

an LNG regasification vessel (12) which is non-integral with said LNG storage vessel (14) and which is coupled to said LNG storage vessel (14) by a pivotal coupling (30) whereby said LNG regasification vessel (12) can be pivoted with respect to said LNG storage vessel (14), said LNG regasification vessel (12) having an LNG vaporization unit (12*d*) disposed thereon;

a separate LNG carrier vessel (22) arranged and designed for docking to said LNG regasification vessel (12);

LNG supply line paths (19*s*, 19*b*) arranged and designed for connecting said LNG carrier vessel (22) to said at least one LNG storage tank (14*a*) and said LNG vaporization unit (12*d*), so that LNG can be transferred from said LNG carrier vessel (22) to said at least one LNG storage tank (14*a*) or said LNG vaporization unit (12*d*);

an LNG supply line path (19*t*) from said at least one LNG storage tank (14*a*) to said LNG vaporization unit (12*d*);

a compressed gas supply line (19*g*) arranged and designed to continuously deliver gas from said LNG vaporization unit (12*d*); and wherein said LNG storage vessel (14) has a forward end (13) and an aft end (15), said LNG storage vessel (14) rotatably coupled to said mooring turret (16) at said forward end (13) and to said regasification vessel (12) at said aft end (15).

11. The offshore LNG terminal of claim 10, wherein said pivotal coupling (30), allows said LNG regasification vessel (12) to rotate with respect to said LNG storage vessel (14).

12. The offshore LNG terminal of claim 10, wherein said mooring turret (16) is operatively coupled to at least one subsea pipeline (18).

13. The offshore LNG terminal of claim 12, wherein said regasification vessel (12) is adapted to regasify LNG stored in said at least one LNG storage tank (14*a*) on said LNG storage vessel (14) and supply compressed gas to said at least one subsea pipeline (18).

14. The offshore LNG terminal of claim 10, wherein said regasification vessel (12) is adapted to regasify LNG supplied from said LNG carrier vessel (22) or from said at least one LNG storage tank (14*a*) on said LNG storage vessel (14).

15. The offshore LNG terminal of claim 10, wherein said mooring turret (16) is positioned exteriorly of said LNG storage vessel (14).

16. The offshore LNG terminal of claim 10, wherein said mooring turret (16) is positioned interiorly of said LNG storage vessel (14).

17. The offshore LNG terminal of claim 10, wherein said LNG regasification vessel (12) is an open frame floating structure (12*c*) having first and second ends and a deck mounted on said open frame floating structure (12*c*).

18. The offshore LNG terminal of claim 17, wherein said open frame floating structure (12*c*) includes a plurality of horizontal pontoons (25) and a plurality of buoyant columns (21).

19. The offshore LNG terminal of claim 10, wherein said regasification vessel (12) further comprises a plurality of thrusters (27) arranged to apply torque to pivot said regasification vessel (12) relative to said LNG storage vessel (14).

* * * * *